US010995717B2

(12) United States Patent
Gruenberger et al.

(10) Patent No.: US 10,995,717 B2
(45) Date of Patent: May 4, 2021

(54) COLLECTING PRESSURE LINE FOR A FUEL INJECTION SYSTEM OF AN INTERNAL COMBUSTION ENGINE

(71) Applicant: Dr. Ing. h.c. F. Porsche Aktiengesellschaft, Stuttgart (DE)

(72) Inventors: Joachim Gruenberger, Sachsenheim (DE); Hartmut Voss, Wimsheim (DE)

(73) Assignee: Dr. Ing. h.c. F. Porsche Aktiengesellschaft

( * ) Notice: Subject to any disclaimer, the term of this patent is extended or adjusted under 35 U.S.C. 154(b) by 0 days.

(21) Appl. No.: 16/785,438

(22) Filed: Feb. 7, 2020

(65) Prior Publication Data

US 2020/0256299 A1 Aug. 13, 2020

(30) Foreign Application Priority Data

Feb. 7, 2019 (DE) ..... 10 2019 103 041.2

(51) Int. Cl.
*F02M 55/04* (2006.01)
*F02M 55/02* (2006.01)

(52) U.S. Cl.
CPC ..... *F02M 55/04* (2013.01); *F02M 55/02* (2013.01)

(58) Field of Classification Search
CPC .. F02M 55/04; F02M 55/02; F02M 2200/315; F02M 2200/9015; F02M 55/025
See application file for complete search history.

(56) References Cited

U.S. PATENT DOCUMENTS 5,575,262 A * 11/1996 Rohde ..... F02M 55/04 123/456
7,497,202 B2 * 3/2009 Cvengros ..... F02M 37/0041 123/456
7,520,268 B1 * 4/2009 Sims, Jr. ..... F02M 55/025 123/447
7,694,664 B1 * 4/2010 Sims, Jr. ..... F16L 55/053 123/456
10,731,611 B2 * 8/2020 Guzman Escalante ..... F02M 37/0041
2008/0142105 A1 * 6/2008 Zdroik ..... F02M 55/025 138/30

(Continued)

FOREIGN PATENT DOCUMENTS

DE 43 41 368 6/1995
DE 103 12 418 10/2003
DE 10 2009 029 219 3/2011

(Continued)

OTHER PUBLICATIONS

German Examination Report dated Sep. 16, 2020.

*Primary Examiner* — Xiao En Mo
(74) *Attorney, Agent, or Firm* — Gerald E. Hespos; Michael J. Porco; Matthew T. Hespos

(57) ABSTRACT

A collecting pressure line (1) for a fuel injection system of an internal combustion engine has a flow-traversable interior (9). The collecting pressure line (1) has at least one injector that is flow-traversable with the aid of a throughflow opening (8). Fluid present in the collecting pressure line (1) is injected with the aid of the injector into a combustion chamber of the internal combustion engine. An elastic member (10) is formed in the interior (9) and is designed to be flow-traversable while bearing against a line inner wall (15) and spaced apart from the throughflow opening (8).

12 Claims, 2 Drawing Sheets

(56) References Cited

U.S. PATENT DOCUMENTS

2020/0316621 A1 10/2020 Yamazaki

FOREIGN PATENT DOCUMENTS

| | | |
|---|---|---|
| DE | 10 2014 226 678 | 6/2016 |
| DE | 11 2016 006 650 | 12/2018 |
| JP | 2005-219566 | 8/2005 |

* cited by examiner

COLLECTING PRESSURE LINE FOR A FUEL INJECTION SYSTEM OF AN INTERNAL COMBUSTION ENGINE

CROSS REFERENCE TO RELATED APPLICATION

This application claims priority under 35 USC 119 to German Patent Appl. No. 10 2019 103 041.2 filed on Feb. 7, 2019, the entire disclosure of which is incorporated herein by reference.

BACKGROUND

Field of the Invention

The invention relates to a collecting pressure line for a fuel injection system of an internal combustion engine.

Related Art

Collecting pressure lines for fuel injection systems for internal combustion engines for fuel injection are known. Each cylinder of the internal combustion engine is assigned a respective injector that is connected in a flow-traversable manner to a collecting pressure line, generally referred to as a fuel rail or fuel distributor. The collecting pressure line is assigned at least two injectors. A fluid to be supplied to the cylinder for combustion is designed to be under pressure in the collecting pressure line and, according to a corresponding injection time of the injector, is supplied via the collecting pressure line to the cylinder. The different injection times of the injectors received on the collecting pressure line result in pressure vibrations in the collecting pressure line that can lead to insufficient fuel supply of the injector and thus of the cylinder.

DE 43 41 368 A1 discloses a collecting pressure line that has a damping element in the collecting pressure line to reduce pressure vibrations. The collecting pressure line is disposed to be surrounded by the fuel. Additionally, the damping element is formed from an elastic material and has gas-filled chambers.

DE 10 2014 226 678 A1 discloses a collecting pressure line for injectors of an internal combustion engine. An elastic damping element with a flow-traversable interior is formed in the collecting pressure line so as to completely cover the collecting pressure line. A hydraulic connection between a fuel reservoir and the injectors is formed via the interior of the damping element.

DE 10 2009 029 219 A1 discloses a collecting pressure line for a fuel injection system of an internal combustion engine whose interior has a damping element. The damping element is designed such that fuel can flow around it.

The object of the invention is to provide an improved collecting pressure line for a fuel injection system of an internal combustion engine.

SUMMARY

A collecting pressure line for a fuel injection system of an internal combustion engine in accordance with the invention has a flow-traversable interior. The collecting pressure line is designed with at least one injector to be flow-traversable with the aid of a throughflow opening. A fluid present in the collecting pressure line is injected with the aid of the injector into a combustion chamber of the internal combustion engine. An elastic means is arranged in the interior. According to the invention, the elastic means is designed to be flow-traversable while bearing against a line inner wall of the collecting pressure line and being spaced apart from the throughflow opening. This leads to effective damping of pressure pulsations with simultaneous reduction of a flow cross section of the collecting pressure line.

The elastic means is configured for damping the pressure pulsations in the collecting pressure line. The pressure lines formed according to the prior art predominantly are configured so that the fuel can flow around the elastic means. In contrast, the damping means of the collecting pressure line according to invention has flow passing through it. Thus, a throughflow of the collecting pressure line occurs independently of the volumetric flow. If the means were to have flow passing around it, regions could be formed with low volumetric flows that have less fuel than remaining regions in the collecting pressure line, thereby resulting in pressure differences in the collecting pressure line. The bearing of the means against the line inner wall is necessary so that the means can be only expandable and compressible and not displaceable. This leads to a determinable pressure in the collecting pressure line. The elastic means of the invention is spaced apart from the throughflow opening that is connected to the injector to obtain a pressure of the fuel that cannot be influenced by damping, particularly in the region of the throughflow opening that is connected to the injector. Consequently, the pressure collecting line according to the invention leads to improved and more uniform injection of fuel into the internal combustion engine, with the result that improved and pollutant-reduced combustion can be realized.

In one embodiment of the collecting pressure line, a nonelastic sleeve is arranged in the interior to form the spacing of the elastic means from the throughflow opening that is connected to the injector. In contrast to the elastic means, the sleeve is nonelastic so that the pressure is not influenced by damping in the region of the throughflow opening. Accordingly, the pressure is determinable and not influenced by an elastic means, with volume reduction nevertheless being present by virtue of the sleeve and its wall thickness. Furthermore, this embodiment leads to a modular and thus cost-effective design of the collecting pressure line with its volume reduction and damping, since the individual parts, namely elastic means and sleeve, can be produced in large quantities and can be used in different collecting pressure lines of different lengths.

To obtain the advantageous throughflow of the elastic means, the sleeve is designed, with the elastic means and with the throughflow opening, to be flow-traversable. This can be realized in a simple manner by forming a further throughflow opening in the sleeve that is configured to extend completely through a wall of the sleeve.

In a further embodiment of the collecting pressure line, the sleeve is connected immovably to the collecting pressure line. Thus, stable positioning of the elastic means in the collecting pressure line is achieved even with pressure change.

Further throughflow openings over a circumference of the sleeve leads to positionally independent positioning of the sleeve, which can be further improved by a circumferential groove formed in the region of the throughflow opening. As a result, reliable supply of the injector with fuel is realized even when the throughflow opening of the collecting pressure line is not superimposed with the further throughflow opening in the sleeve, since the fuel can accumulate and be distributed over the circumference of the sleeve.

The collecting pressure line is designed to inject fuel and/or fuel-water emulsion into the internal combustion engine. This means that in particular the elastic means is formed from a material which is in particular fuel-resistant.

Water injection is primarily used for internal cooling of a combustion chamber of the internal combustion engine. This cooling makes it possible to considerably reduce the knock tendency of the internal combustion engine and thus to increase the performance of the internal combustion engine and/or to allow enrichment in high load ranges to be dispensed with. In order that quick volume displacement of the water occurs particularly upon change into operating ranges below the water injection, which is preferably carried out at high load points and rotational speed points of the internal combustion engine, it is expedient to make an effective flow diameter of the collecting pressure line as small as possible and as large as necessary. This is particularly achieved with the aid of the elastic means, which is provided for damping pressure pulsations and also for volume reduction.

The outlet bores leading to the injectors that situated lower than or at the same height as the inner volume of the rail. This prevents, during emulsion injection, deposition of water (in the case of segregation of fuel and water) in the rail volume.

The elastic means may be annular or tubular such that a flow-traversable interior can be achieved in a simple manner with simultaneous bearing of the elastic means against the inner surface of the collecting pressure line. Furthermore, annularly configured elastic means can be produced in an extrusion process in the form of a long part in a simple and cost-effective manner, the means, prior to being mounted, being able to be cut from the part to its correspondingly required length.

In a further embodiment of the collecting pressure line according to the invention, the sleeve has, at its end formed facing the means, a receiving ring whose diameter is at most equal to an inside diameter of the elastic means and less than an outside diameter of the sleeve. Thus, the end of the sleeve facing the means may have a shoulder onto which the elastic means can be pushed and positioned. This is particularly advantageous in the case of a sleeve which has plural throughflow openings over its circumference, since before inserting the elastic means and the sleeve into the interior of the collecting pressure line, the sleeve can now be connected to the elastic means and can be pushed jointly into the interior. Since exact positioning of the sleeve on the throughflow opening is not necessary on account of the plurality of further throughflow openings, the result of this is cost-effective mounting of the collecting pressure line, which in turn leads to cost-effective production thereof.

If an outside diameter of the elastic means is at least equal to an inside diameter of the collecting pressure line, bearing of the elastic means against the inner surface of the collecting pressure line can be brought about in a simple manner. Particularly if the outside diameter is greater than the inside diameter, compression of the elastic and hollow means can achieve secure bearing thereof on the inner surface of the collecting pressure line.

To ensure that simple mounting is maintained, an outside diameter of the sleeve is at most equal to an inside diameter of the collecting pressure line. Consequently, the sleeve can also be guided in conjunction with the elastic means into the interior of the collecting pressure line in a simple manner, with simultaneous formation of the bearing of the sleeve against the line inner wall.

Further advantages, features and details of the invention will emerge from the following description of preferred exemplary embodiments and from the drawing. The features and feature combinations mentioned above in the description and the features and feature combinations mentioned below in the description of the figures and/or shown in the figures alone are able to be used not only in the respectively specified combination but also in other combinations or individually without departing from the scope of the invention. Identical or functionally identical elements are denoted by identical reference signs.

DETAILED DESCRIPTION

Figure 1:
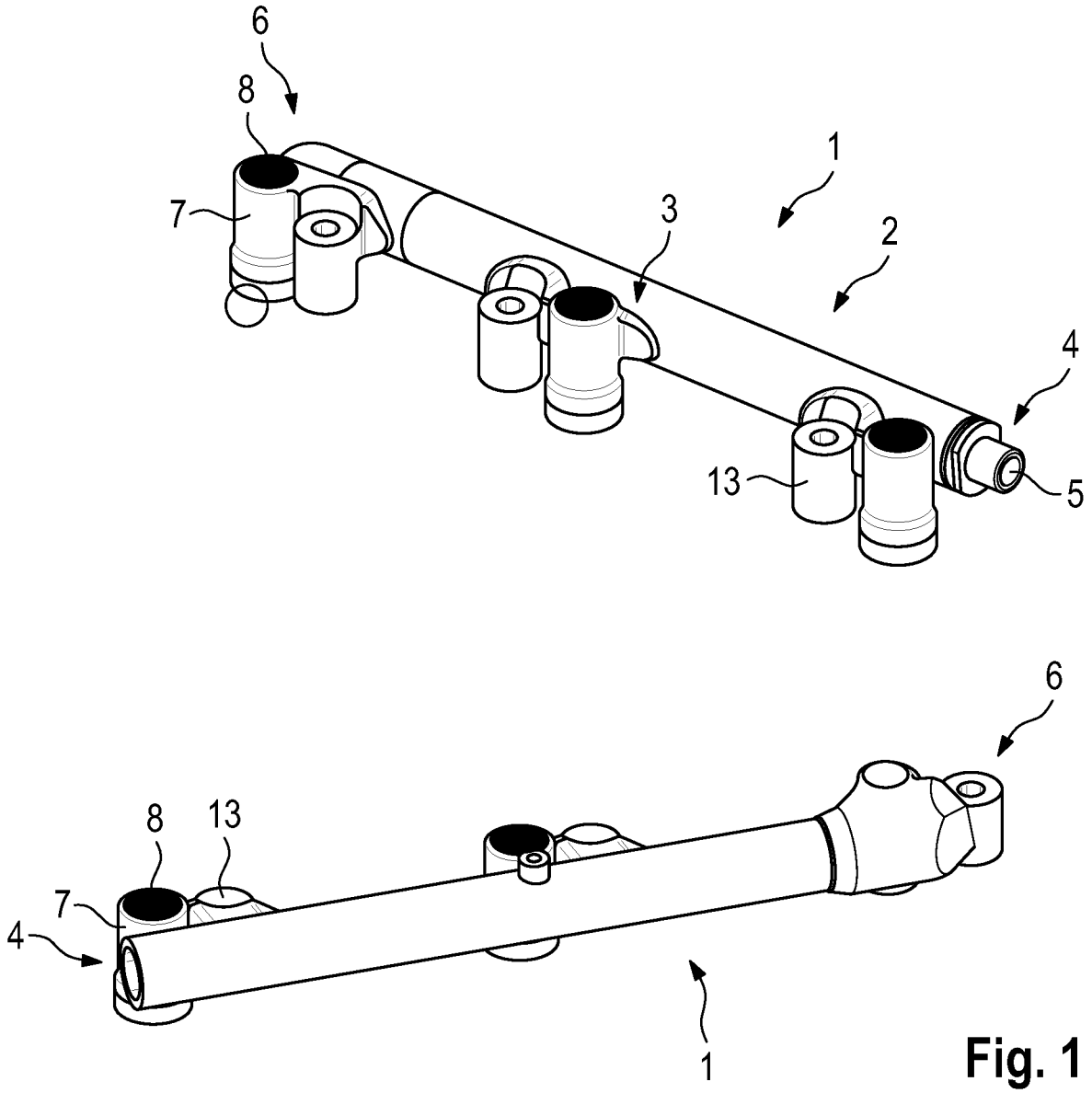
FIG. 1 is a perspective illustration showing collecting pressure lines according to the invention of a fuel injection system for an internal combustion engine.

A collecting pressure line 1 according to the invention is shown in FIG. 1 and is used in a fuel injection system 2 for an internal combustion engine having two banks of cylinders. The collecting pressure line 1 is a distributor often called a fuel rail or a fuel distributor. The collecting pressure line 1 has flow-traversable receiving openings 3 according to a number of the cylinders to be supplied. Each flow-traversable receiving opening 3 is equipped with an injector (not illustrated in further detail). In the illustrated embodiment, the collecting pressure line 1 has three receiving openings 3, and therefore three cylinders of the internal combustion engine are supplied with fuel via the collecting pressure line 1. The collecting pressure line 1 also could be designed to supply two, four or more injectors and accordingly would have two, four or more receiving openings 3.

The collecting pressure line 1, as central hydraulic component, interconnects a fuel pump (not illustrated in further detail) in the form of a high-pressure pump and the injectors. Compressed fuel is present in the collecting pressure line 1 and, according to an injection time of the internal combustion engine, is made available to the corresponding injector(s). The fuel passes via the injector into a combustion chamber of the internal combustion engine.

The collecting pressure line 1 is a hollow tube in which the fuel is present and can flow therethrough. A first end 4 of the collecting pressure line 1 in the axial direction along its longitudinal axis 14 has a flow-traversable connection 5 that can be connected to the fuel pump such that flow can pass through. A second end 6 facing away from the first end 4 is closed in a non-flow-traversable manner.

The flow-traversable receiving openings 3 are formed with the aid of cylindrical tubes 7 in these exemplary embodiments. Each tube 7 is connected to the collecting pressure line 1 to be flow-traversable with the aid of a unilaterally closed throughflow opening 8 formed in the collecting pressure line 1. Thus, each tube 7 is assigned a throughflow opening 8.

The collecting pressure line 1 has an interior 9 with a volume-reducing and pressure pulsation-damping means 10 (referred to herein after as elastic means 10) that is hollow and thus flow-traversable.

Figure 2:
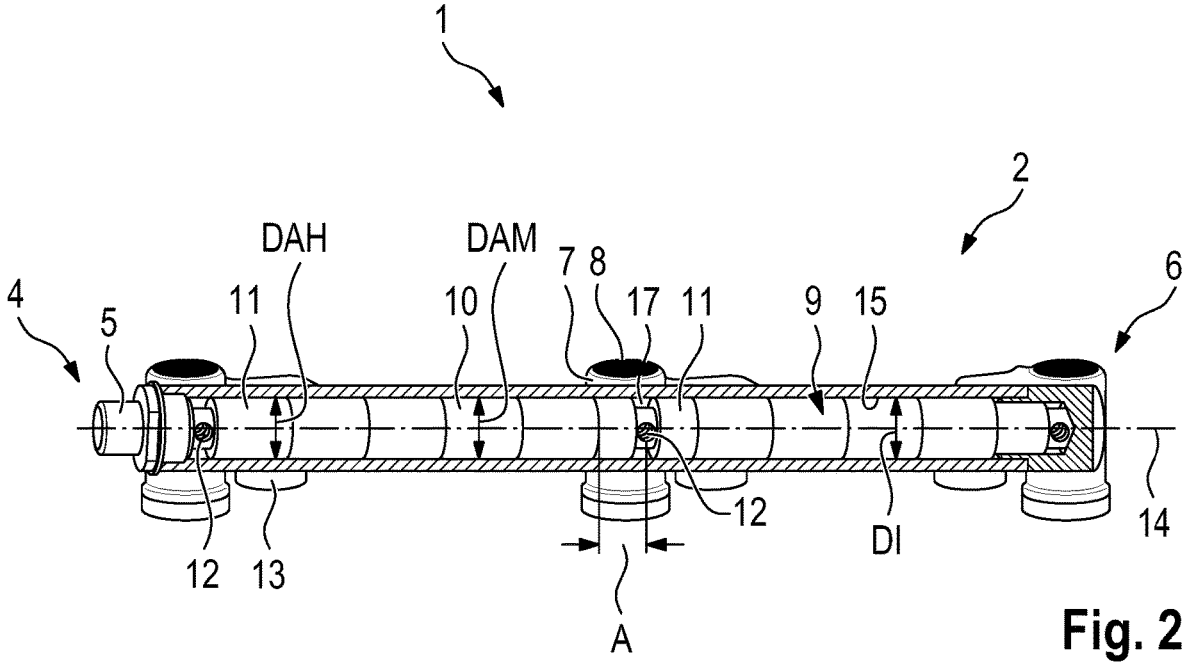
FIG. 2 is a longitudinal section showing the collecting pressure line according to the invention in a first exemplary embodiment.

The pressure pulsation-damping means 10 is elastic and is referred to hereinafter simply as an elastic means 10. In the embodiment of FIG. 2, the elastic means 10 is formed from an elastic material in the form of an elastomer. When using plastics, care must be taken to ensure that the plastic is fuel-compatible, in other words fuel-resistant, and no reaction with the fuel can occur.

In the first embodiment, the elastic means 10 is defined by rings in the form of hollow cylinders that are arranged next to one another in a flow-traversable manner. In each case, a sleeve 11 having further throughflow openings 12 is arranged in the region of the throughflow opening 8. Thus, in each case one elastic means 10 is between two sleeves 11 that are arranged immovably in the collecting pressure line 1. A spacing A of the elastic means 10 from the throughflow opening 8 is formed with the aid of the sleeve 11.

The sleeve 11 preferably is formed from metal, but could be configured from a plastic, and preferably from a non-elastic plastic. In this first embodiment, the elastic 10 has four rings arranged next to one another.

Figure 3:
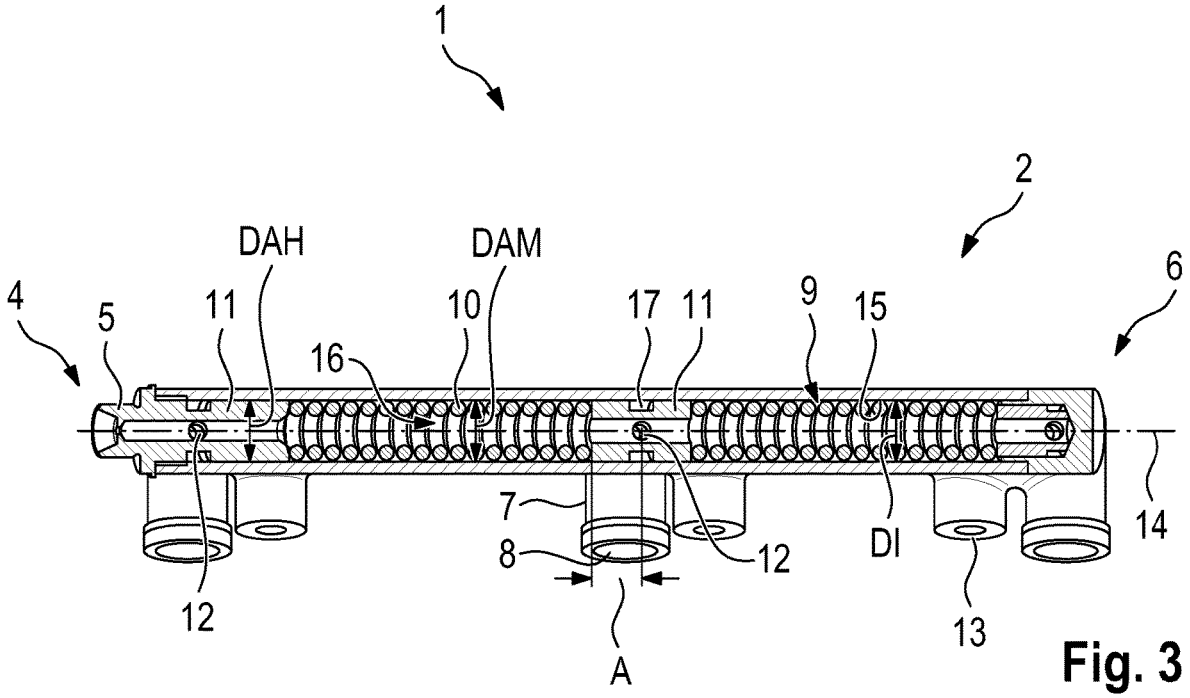
FIG. 3 is a longitudinal section showing the collecting pressure line according to the invention in a second exemplary embodiment.

The second embodiment is illustrated in FIG. 3 and has the elastic means 10 in the form of flow-traversable sealing elements in the form of so-called O-rings that are arranged next to one another. The individual O-rings 10, like the individual rings of the first embodiment, can be connected to one another in an integrally bonded manner, or they can be arranged next one another in a sealing manner. The elastic means 10 also could be formed in one piece.

In both exemplary embodiments, the elastic means 10 bears against an inner surface 15 of the collecting pressure line 1, and is substantially traversed by the flow of the fuel, with a further interior 16 of the elastic means 10 being flow-traversable. Fuel can be guided from the further interior 16 into a circumferential groove 17 of the sleeve 11 via the further throughflow openings 12 such that the fuel necessary for injection can flow into the throughflow opening 8 and thus into the injector even independently of an exact positioning of the further throughflow opening 12 above the throughflow opening 8.

To provide bearing against the collecting pressure line 1, an outside diameter DAM of the elastic means 10 is equal to an inside diameter DI of the collecting pressure line 1. It could also be greater, since the elastic means 10 is designed to be compressible. However, it should not be so large that the elastic means 10 still is configured for the throughflow of sufficient fluid for the internal combustion engine. An outside diameter DAH of the sleeve 11 is precisely equal to the inside diameter DI of the collecting pressure line 1 such that it can be readily joined.

The fuel that flows through the collecting pressure line 1 can be pure fuel or an emulsion consisting of fuel and for example water.

Pressure pulsations occur in the collecting pressure line 1 as a result of the injection process. To securely support the collecting pressure line 1 there is formed alongside each tube 7 a respective supporting element 13 for fixing the collecting pressure line 1 on the internal combustion engine. The supporting element 13 could also be formed at other points of the collecting pressure line 1, although, given an opening and closing of the injector and the associated body vibrations, the arrangement of the supporting element 13 close to the tube 7 produces better support of the collecting pressure line 1.

What is claimed is:

1. A collecting pressure line for a fuel injection system of an internal combustion engine, the collecting pressure line having a flow-traversable interior (9), the collecting pressure line having at least one injector that is flow-traversable with the aid of a unilaterally closed throughflow opening so that fluid present in the collecting pressure line is injected with the aid of the injector into a combustion chamber of the internal combustion engine, and an elastic means being in the interior, wherein the elastic means is flow-traversable while bearing against an inner surface of the collecting pressure line and being spaced by a spacing from the throughflow opening.

2. The collecting pressure line as claimed in claim 1, further comprising a nonelastic sleeve is arranged in the interior to form the spacing between the elastic means and the throughflow opening.

3. The collecting pressure line of claim 2, wherein the sleeve, the elastic means and the throughflow opening are flow-traversable.

4. The collecting pressure line of claim 2, wherein the sleeve is immovably connected to the connecting pressure line.

5. The collecting pressure line of claim 2, wherein the sleeve has further throughflow openings at spaced apart positions over its circumference.

6. The collecting pressure line of claim 5, wherein the sleeve has a circumferential groove communicating with the throughflow opening.

7. The collecting pressure line of claim 2, wherein an end of the sleeve facing the elastic means has a receiving ring with a diameter that is at most equal to an inside diameter of the elastic means and less than an outside diameter of the sleeve.

8. The collecting pressure line of claim 2, wherein an outside diameter of the elastic means is at least equal to an inside diameter of the collecting pressure line.

9. The collecting pressure line of claim 2, wherein an outside diameter of the sleeve is at most equal to an inside diameter of the collecting pressure line.

10. The collecting pressure line of claim 1, wherein the elastic means is formed from a fuel-resistant material.

11. The collecting pressure line of claim 1, wherein the elastic means comprises annular or tubular sections.

12. The collecting pressure line of claim 1, wherein the elastic means comprises annular O-rings.

* * * * *